US007997586B2

(12) United States Patent
Ziegler et al.

(10) Patent No.: US 7,997,586 B2
(45) Date of Patent: Aug. 16, 2011

(54) OSCILLATORY DRIVE

(75) Inventors: Rolf Ziegler, Sonnenbuehl (DE); Uwe Frueh, Sonnenbuehl (DE); Adolf Hecht, Lichtenstein (DE)

(73) Assignee: C. & E. Fein GmbH (DE)

( * ) Notice: Subject to any disclaimer, the term of this patent is extended or adjusted under 35 U.S.C. 154(b) by 1138 days.

(21) Appl. No.: 11/744,321

(22) Filed: May 4, 2007

(65) Prior Publication Data

US 2007/0295156 A1 Dec. 27, 2007

(30) Foreign Application Priority Data

May 4, 2006 (DE) ..... 10 2006 021 969

(51) Int. Cl.
*B23B 31/11* (2006.01)

(52) U.S. Cl. ..... 279/8; 279/7; 30/329; 606/82

(58) Field of Classification Search ..... 279/7, 8, 279/89–91; 30/166.3, 329; 606/82, 176; 451/159, 163

See application file for complete search history.

(56) References Cited

U.S. PATENT DOCUMENTS

| | | | | |
|---|---|---|---|---|
| 5,058,909 | A | 10/1991 | Rudolf et al. | |
| 5,601,483 | A | 2/1997 | Rudolf et al. | |
| 6,796,888 | B2 | 9/2004 | Jasch | |
| 6,802,764 | B2 | 10/2004 | Besch | |
| 6,945,856 | B2 | 9/2005 | Boyd et al. | |
| 7,189,239 | B2 * | 3/2007 | Fisher et al. | 606/82 |
| 7,217,177 | B2 | 5/2007 | Frech et al. | |
| 7,344,435 | B2 * | 3/2008 | Pollak et al. | 451/342 |
| 2002/0030328 | A1 * | 3/2002 | Nock et al. | 279/8 |
| 2007/0016238 | A1 * | 1/2007 | Marietta | 606/176 |
| 2009/0023371 | A1 * | 1/2009 | Blickle et al. | 451/359 |

FOREIGN PATENT DOCUMENTS

| | | |
|---|---|---|
| DE | 30 12 836 | 10/1981 |
| DE | 38 06 145 | 9/1989 |
| DE | 39 02 874 | 8/1990 |
| DE | 43 36 620 | 5/1995 |
| DE | 201 17 159 | 2/2002 |
| DE | 103 52 501 | 6/2005 |

(Continued)

OTHER PUBLICATIONS

European Search Report, Jun. 5, 2007, 4 Pages.

*Primary Examiner* — Eric A Gates
(74) *Attorney, Agent, or Firm* — St. Onge Steward Johnston & Reens LLC

(57) ABSTRACT

The invention relates to an oscillatory drive having an output shaft that can be driven to perform a rotationally oscillating movement about its longitudinal axis and that comprises a free end, a holding fixture at the free end of the output shaft comprising a contact surface for attachment of a tool, a mounting section on the holding fixture, raised relative to the contact surface, that projects to the outside in the direction of the longitudinal axis and that is designed for form-locking connection with a mounting opening of a tool placed in contact with the contact surface, and having a securement for fixing the tool with its mounting opening on the holding fixture, the securement permitting the tool to yield in axial direction under the action of a torque, against a pre-stress, and the mounting section permitting the tool to rotate by a certain angle of rotation when the tool gives way axially.

20 Claims, 4 Drawing Sheets

FOREIGN PATENT DOCUMENTS

| | | |
|---|---|---|
| DE | 20 2006 001 643 | 3/2006 |
| DE | 10 2004 050 798 | 4/2006 |
| EP | 1 213 107 | 6/2002 |
| FR | 21 31 299 | 11/1972 |
| JP | 2000-1 90 155 | 7/2000 |
| WO | 03/1 03 897 | 12/2003 |

* cited by examiner

OSCILLATORY DRIVE

CROSS-REFERENCE TO RELATED APPLICATIONS

The present application claims priority of German patent application 10 2006 021 969.4 filed on May 4, 2006, the content of which is incorporated herein by reference.

FIELD OF THE INVENTION

The present invention relates to an oscillatory drive having an output shaft that can be driven to perform a rotationally oscillating movement about its longitudinal axis and that comprises a free end, a holding fixture at the free end of the output shaft comprising a contact surface for attachment of a tool, a mounting section on the holding fixture, raised relative to the contact surface, that projects to the outside in the direction of the longitudinal axis and that is designed for form-locking connection with a mounting opening of a tool placed in contact with the contact surface, and a securement for fixing the tool with its mounting opening on the holding fixture.

BACKGROUND OF THE INVENTION

An oscillatory drive of that kind is known from U.S. Pat. No. 6,945,862 B2.

The term oscillatory drive as used herein is meant to describe a drive the output shaft of which performs a rotatingly oscillating movement in operation. A tool mounted on the output shaft can then be used in multiple ways, for example for sawing, cutting or grinding.

Basically, there have been known two ways of connecting a tool with an output shaft. According to a first variant, the tool is urged against a holding fixture at the free end of the output shaft by a clamping element, for example a clamping screw, so that a high frictional force is produced between the tool and the holding fixture. A connection of that kind is described as frictional connection.

According to a second variant, the holding fixture or the tool comprises a mounting section capable of engaging a correspondingly shaped mounting opening in the respective matching part. Transmission of torques is achieved in this case by form-locking connection between the mounting section and the mounting opening. Compared with a frictional connection, a form-locking connection provides the advantage that it permits transmission of even very high torques.

However, when used in continuous operation, oscillatory drives have also shown certain disadvantages regarding the transmission of high torques to the tools. For example, the mounting openings may get worked out in part. After extended operation, heating-up of the tools by the oscillatory drive has also been observed.

SUMMARY OF THE INVENTION

In view of this, it is a first object of the present invention to disclose an improved oscillatory drive that reduces the disadvantages inherent with a form-locking transmission of torques to the tool.

It is a second object of the invention to disclose an improved oscillatory drive that allows a safe transmission of a high torque to a tool while avoiding significant heating of the tool.

It is a third object of the invention to disclose an improved oscillatory drive that reduces vibrations generated by the oscillatory movement of the tool.

These and other objects are achieved according to the invention by an oscillatory drive of the above-mentioned kind where the tool is held on the mounting section to resiliently yield in axial direction under the action of a torque, against a pre-stress, and the mounting section permits the tool to rotate by a certain angle of rotation when the tool gives way axially.

The object of the invention thereby is fully achieved.

The oscillatory drive according to the invention combines the advantages of a form-locking connection, namely the possibility to transmit high torques, with the advantages of a frictional connection, namely that overloading can be avoided.

According to the invention, the torque generally is transmitted by form-locking connection between the mounting section of the output shaft and the mounting opening of the tool.

When the loading of the oscillatory drive rises, the oscillatory drive according to the invention now allows the tool to yield a little in axial direction, relative to the longitudinal axis of the drive shaft. As a result of that axial yielding of the tool, the tool moves into a portion of the mounting section that allows rotation of the tool by a certain angle of rotation.

One thereby achieves a certain resilience under high loads that permits a certain relative movement of the tool with respect to the output shaft. This has the effect to reduce possible torque peaks. At the same time, this also reduces the risk of heat developing by the transmission of torques and prevents the mounting opening from being worn.

The newly provided possibility to have the tool yield axially relative to the contact surface and to rotate by a certain angle of rotation causes the force acting upon the mounting section in the plane of oscillation to be split up into two components, namely an axially acting force component to which the tool reacts by pressing axially against the securement, and a remaining force component acting in the plane of oscillation.

As soon as the load acting on the tool decreases again, the securement pushes the tool back into its form-locking initial position. The force opposed to the axial displacement of the tool by the securement is obtained by the fact that the securement is given an elastic and/or resilient portion or is received in an elastic and/or resilient fashion.

The securement presses elastically and/or resiliently against the tool already in its initial position, thereby retaining it in its form-locking seat. Under high loads, the tool counteracts the force exerted by the securement so that in a way part of the force that acts on the mounting section is directed against the securement. The fact that the tool gives way axially causes the force exerted by the securement to rise and to urge the tool back into its secure form-locking position as soon as the increased load diminishes.

According to one embodiment of the invention, the mounting section widens at least over a certain area in a direction parallel to the longitudinal axis and toward the contact surface.

The width of the mounting section is determined in a plane vertical to the longitudinal axis, and is measured along an arc of a circle which has its center located on the longitudinal axis. To describe the increase in width of the mounting section toward the contact surface it therefore can be said that the width of the mounting section in a first plane, extending vertically to the longitudinal axis, is larger than its width in a parallel plane further remote from the contact surface than the first plane.

Put in other words this means that the mounting section becomes narrower or tapers in a direction away from the contact surface at least in one area. This could especially mean that the base of the mounting section, by which the mounting section rests on the contact area, is larger than the surface of the mounting section opposite its base. Unless the afore-mentioned surfaces are plane it is necessary to give due consideration to the respective superficial measure, related to a plane vertical to the longitudinal axis.

According to another embodiment of the invention, the mounting section comprises a plurality of projections extending radially to the outside, related to the longitudinal axis.

Such projections permit the form-locking seat and the desired transmission of torques to be realized especially efficiently.

According to a further embodiment of the invention, each projection forms at least one flank starting from the contact surface and having a straight line as its base line on the contact surface.

In that case, a corresponding contact surface having a straight base line should likewise be formed at the mounting opening of the tool. Transmission of the torque can then occur along the entire straight line. This can then eliminate punctual loading between the mounting element and the mounting opening so that areas of especially high heat load can be avoided.

According to a further embodiment of the invention, the surface of the flank forms a planar trapezoid.

With the surface of the flank designed in this way, especially good forced sliding of the part of the mounting opening that corresponds with that flank will be achieved during rotation of the tool. Further, it is an advantage of that embodiment that the amount of forced sliding of that part of the mounting opening and, thus, the amount the tool gives way axially are approximately proportional to the force that acts upon the tool in the plane of oscillation. This means that the higher the load acting on the tool, the greater will be the distance the tool can give way axially.

According to another embodiment of the invention, the angle enclosed between the flank and the longitudinal axis is between 5° and 40°, preferably between 10° and 25°, especially between 13° and 17°. The angle may be selected in consideration of the materials to be paired, such as steel and steel, or steel and aluminum.

Within that range of angles, good balancing is ensured between secure form-locking torque transmission on the one hand and the desired resilience in the sense of rotation under high load on the other hand.

According to a further embodiment of the invention, the output shaft comprises a tension element, biased by a spring element, on which the securement can be located.

In the case of that embodiment, the securement, for example a fixing pin, is held by the substantially rigid tension element, and the tension element in turn is held resiliently in the oscillatory drive by the spring element. The principle of such a structure has been known, for example, from DE 39 02 874 A1.

According to a further embodiment of the invention, the securement comprises an elastic and/or resilient section.

In the case of that embodiment, the tool is held by an element which due to its partly elastic and/or resilient property permits the tool to give way axially. Such a securement can be realized, for example, as a clamping screw the screw head of which offers a certain elasticity or can be displaced elastically relative to its barrel.

According to another embodiment of the invention, the mounting section has a polygonal shape, preferably a hexagonal shape, in cross-section.

According to a further embodiment of the invention, the projections have a symmetric design, related to the direction radial to the longitudinal axis, and each of them comprises two flanks that are interconnected by a common curved area that faces away from the longitudinal axis.

According to another embodiment of the invention, the flanks approach each other at an angle of between 5° and 35°, preferably between 10° and 25°, especially between 12° and 18°.

According to a further embodiment of the invention, the flanks of the projections terminate by an undercut in an area close to the longitudinal axis.

It can be ensured with the aid of this feature that the transmission of torques will not occur in the innermost area of the projection, viewed radially from the longitudinal axis, but rather in its central, in some cases also in its outer area.

It is understood that the features of the invention mentioned above and those yet to be explained below can be used not only in the respective combination indicated, but also in other combinations or in isolation, without leaving the scope of the present invention.

BRIEF DESCRIPTION OF THE DRAWINGS

Further features and advantages of the invention are illustrated in the drawing and will become apparent from the detailed description that follows. In the drawings.

DETAILED DESCRIPTION OF THE INVENTION

Figure 1A:
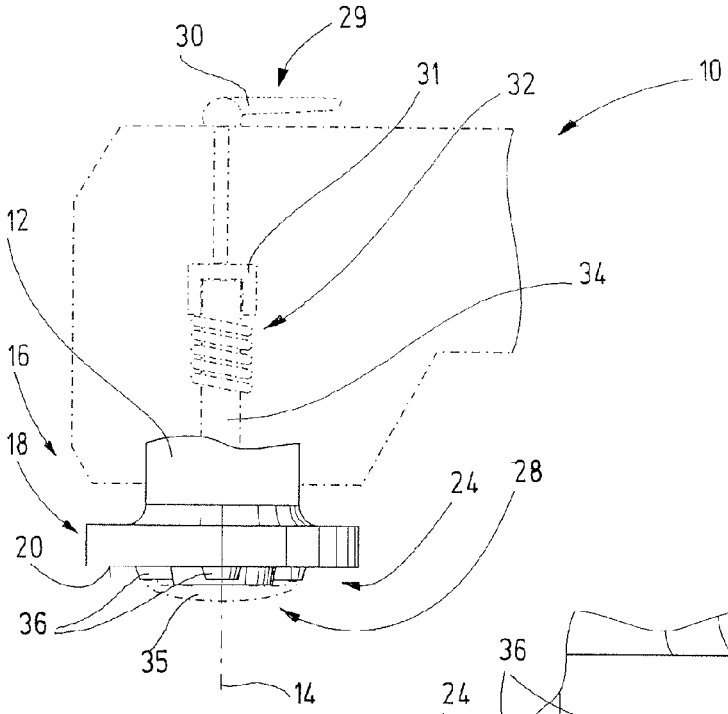
FIG. 1*a* shows a side view of a holding fixture of an oscillatory drive.
Figure 1B:
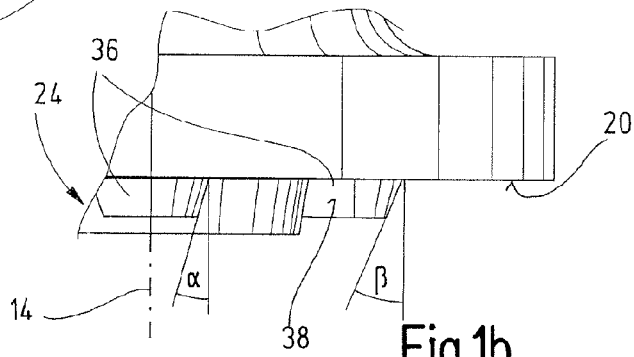
FIG. 1*b* shows an enlarged view of the holding fixture illustrated in FIG. 1*a*.
Figure 3:
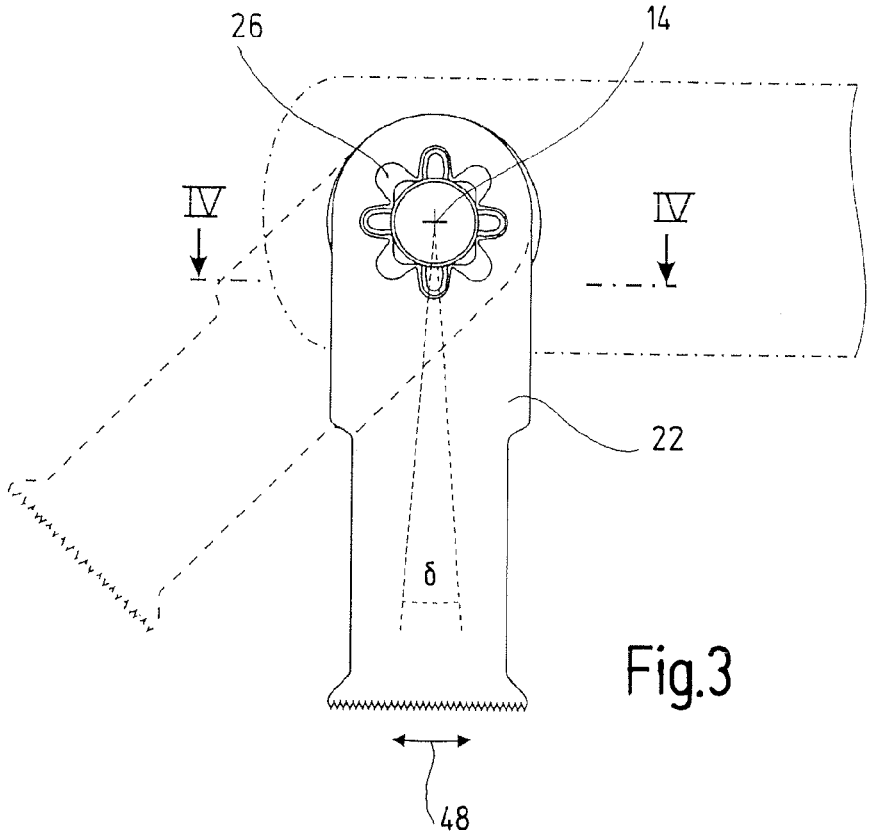
FIG. 3 shows the holding fixture according to FIG. 1*a*, with an attached tool.

FIG. 1*a* shows an oscillatory drive 10 with an output shaft 12, that can be driven to oscillate rotatingly about its longitudinal axis 14, and with a free end 16. The free end 16 carries a holding fixture 18 with a contact surface 20 intended to receive a tool 22 (FIG. 3). An enlarged detail of the holding fixture 18 is illustrated in FIG. 1*b*.

A mounting section 24 arranged on the holding fixture 18 projects outwardly from the contact surface 20 in the direction of the longitudinal axis 14 and is adapted for form-locking connection to a mounting opening 26 (FIG. 3) of a tool 22 attached to the contact surface 20.

The oscillatory drive 10 further comprises a quick-change clamping device 29 with a clamping lever 30 by means of which a tension element 31 received in the output shaft 12 can be displaced axially between a working position and an inoperative position. The tension element 31 may carry a securement 28, for example in the form of a screw, that passes through the mounting opening 26 in a tool 22 fitted on the mounting section 24.

In the inoperative position, the tension element 31 is pushed in axially outward direction by the clamping lever 30 so that the securement 28 can be released in this position without the aid of any implement for changing the tool 22. Turning over the clamping lever 30 will move the tension element 31 into its working position in which the tension element 31 is tensioned under the effect of a spring element 32 so that the securement 28 and, accordingly, the tool 22 are biased against the contact surface 20 of the holding fixture 18 under the action of the spring element 32.

The securement 28 is indicated in the drawing as a pin 34 with a head 35 fitted in the tension element 31.

However, it is also imaginable—especially when the oscillatory drive 10 does not comprise a quick-change clamping device 29 and, thus, a spring element 32—to give the edge of the head 35 a resilient configuration so as to allow the tool 22 to be axially displaced in which case the head 35 of the pin 34 will exert a restoring force on the tool 22.

Having the securement 28 mounted resiliently has the effect that the securement 28 can be displaced even against the force exerted by the spring element 32, i.e. away from the contact surface 20, if a correspondingly high force is exerted on the securement 28.

Consequently, either the tension element 31 or the securement 28 allows the tool 22 to be axially displaced. The force required to counteract the pre-stress of the securement 28 is provided by the torque acting between the output shaft 12 and the tool 22, as will be explained hereafter in more detail.

The mounting section 24 comprises in this case four projections 36 all arranged about the longitudinal axis 14 at an angle of 90° one relative to the other. (One of the projections 36 is hidden in this Figure.) The projections 36 are connected one with the other by arc-shaped sections 44 that extend concentrically to the longitudinal axis 14. All in all it can be noted that the mounting section 24 widens in a direction parallel to the longitudinal axis 14 and in a direction toward the contact surface 20.

Figure 2A:
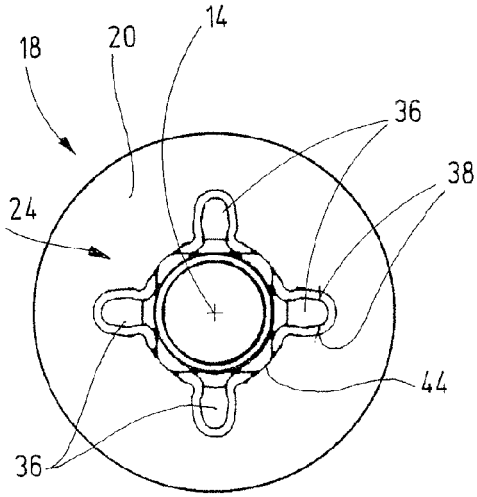
FIG. 2*a* shows a side view of the holding fixture according to FIG. 1*a* comprising four projections.
Figure 2B:
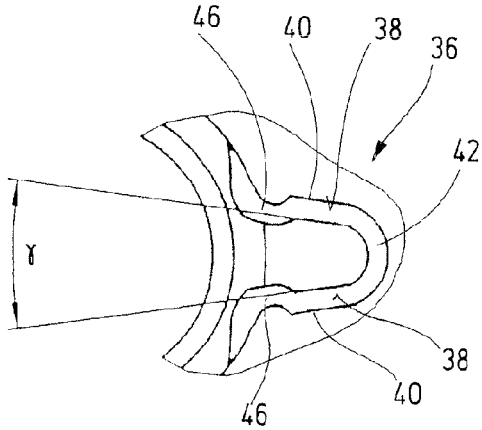
FIG. 2*b* shows an enlarged detail of one projection according to FIG. 2*a*.

When viewing FIGS. 2*a* and 2*b*, showing a top view of the holding fixture 18 and an enlarged view of one projection 34, as a whole it will be seen that the projections 36 have a symmetrical shape, viewed in a radial direction relative to the longitudinal axis 14, and comprise two flanks 38 each that are interconnected by a common curved area 42 that faces away from the longitudinal axis 14. The ground line 40 of each of the flanks 38 on the contact surface 20 is a straight line.

In a side view similar to FIGS. 1*a*, 1*b*, each of the flanks 38 forms a planar trapezoid. The angle α enclosed between each flank 38 and the longitudinal axis 14 is approximately 50° in this case. The angle ββat the rounded portion of the projection 36 is likewise approximately 50° in this case, although it may be selected to be different from the angle α, if desired.

As can be seen especially in FIG. 2*b*, the projection 36 tapers in radial direction, from the longitudinal axis 14 toward the outside. The tapering shape is obtained by an arrangement where the flat flanks 38 approach each other in radially outward direction. The angle γ between the two flat flanks 38 is approximately 15° in this case.

In addition to the before-mentioned tapering shape, the flanks 38 of the projections 36 terminate by an undercut 46 in an area close to the longitudinal axis 14. This may have the effect that force transmission between the output shaft 12 and the tool 22 occurs mainly or exclusively along the flanks 38.

FIG. 3 shows the oscillatory drive 10 with a tool 22 fitted. The mounting opening 26 comprises eight recesses adapted in shape and size to the projections 36, so that the tool 22 can be fitted in different positions—as illustrated by the broken line. The direction of oscillation of the oscillatory drive 10 is indicated by a double arrow 48.

Once the tool 22 is in contact with the contact surface 20, a form-locking connection is established between the mounting section 24 and the mounting opening 26. The permitted angle of rotation δδ is shown symbolically. It can be noted that the amount of the angle of rotation δ is greatly exaggerated in this case, for illustration purposes, and that the angle of rotation δ occurring in practice will be clearly smaller, especially in the order of less than 1°. The angle of rotation δ maximally possible in theory is limited by the design of the quick-change clamping device 29 or the securement 28, respectively, as a form-locking connection will be established in each end position. In practice, however, the oscillations occurring at high frequency (~5000 to 30,000 oscillations per minute) and a small oscillating angle (0.5° to 7°) will result in very small angles of rotation δ.

Figure 4:
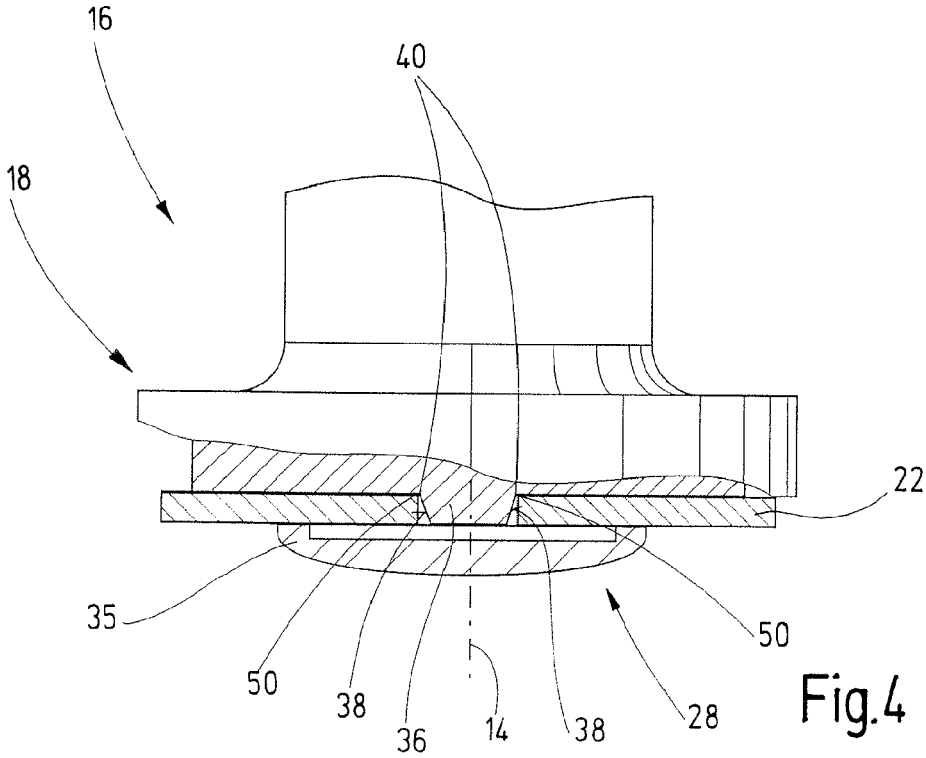
FIG. 4 shows a section through the holding fixture illustrated in FIG. 1*a*, taken along line IV-IV, with a tool mounted and a securement fitted.

FIG. 4 shows the holding fixture 18 with a fitted tool 22, the tool 22 being urged against the contact surface 20 by the securement 28.

It can be seen that edges 50 of the mounting opening 26 of the tool 22 are in contact with the projection 36 in the area of the ground line 40. Consequently, the torque is transmitted from the output shaft 12 to the tool 22 by a form-locking connection.

Figure 5A:
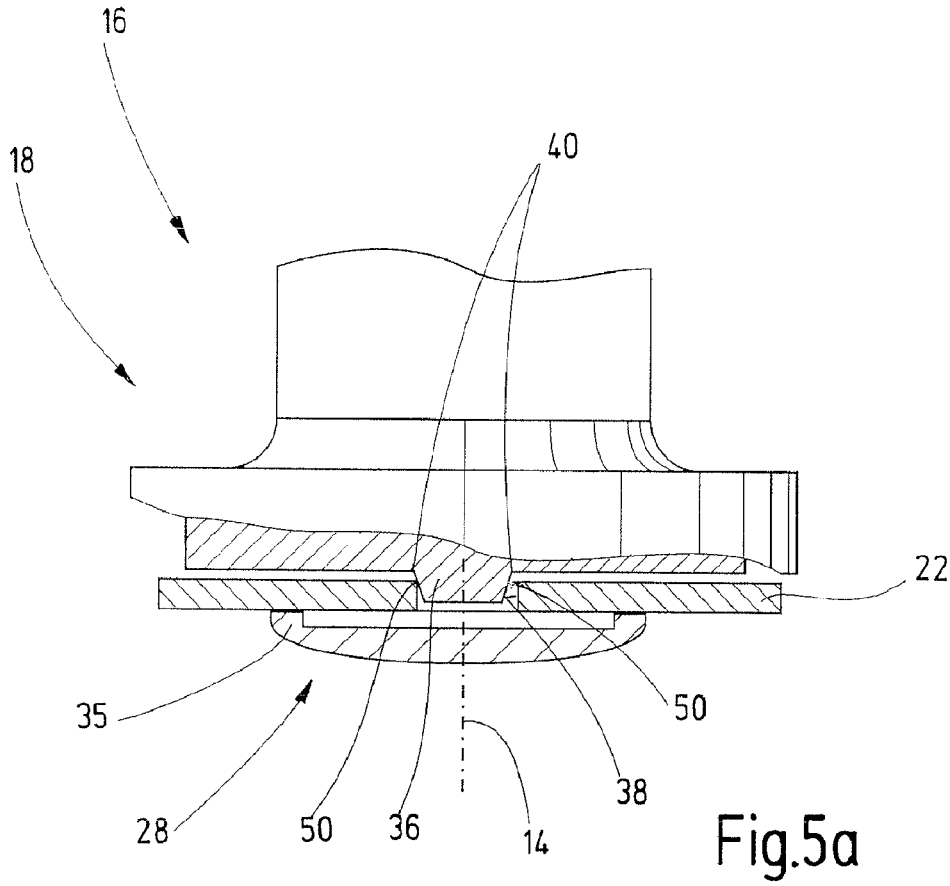
FIG. 5*a* shows the holding fixture illustrated in FIG. 4, with the tool displaced axially and rotated by a certain angle of rotation.
Figure 5B:
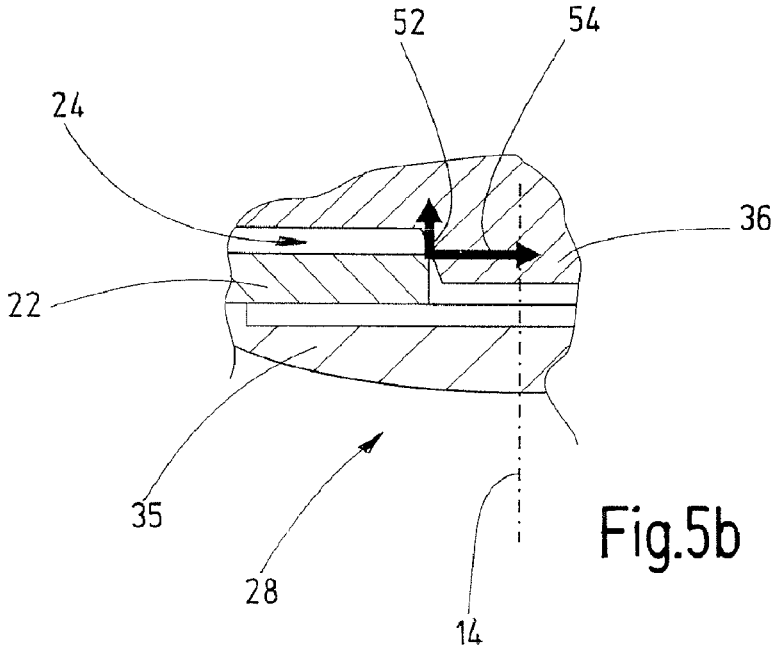
FIG. 5*b* shows an enlarged detail of the holding fixture according to FIG. 5*a*.

The situation obtained when the tool 22 is subjected to high loads is illustrated in FIGS. 5*a* and 5*b* which show the holding fixture 18 and an enlarged section of the holding fixture 18, respectively.

It can be noted that the tool 22 has been lifted off the contact surface 20 in the axial direction. Here again, the axial displacement has been greatly exaggerated in the drawing, for improved clarity. The inclined flank 38 has the effect that the force that previously acted on the mounting section 24, especially on the projections 36, in a plane perpendicular to the longitudinal axis 14, is converted in part to a force that acts axially to the longitudinal axis 14. The force acting in the axial direction is indicated by an arrow 52. The remaining force component, acting transversely to the longitudinal axis 14, is indicated by an arrow 54.

The force acting on the tool 22 has the effect that the mounting opening 26 of the tool slides up along the flank 38. As a reaction to the axial force component 52, the tool 22 counteracts the pre-stress of the securement 28, while the force component 54 causes the tool 22 to rotate by an angle of rotation δ. Rotation of the tool can occur when the axial force component 52 exceeds the pre-stress produced by the spring element.

When the load on the tool 22 diminishes again, or the direction of oscillation changes, the axial force component 52 will decrease again and the tool 22 will be urged against the contact surface 20 by the securement 28.

The certain degree of resilience of the tool 22 at high torques has the effect that torque peaks, produced by the oscillating movement, are absorbed and, consequently, heating-up of the tool and wearing of the mounting opening 26 are reduced.

Resilience can be achieved with advantage especially in an oscillatory drive 10 with a quick-change clamping device 28 because in this case advantage can be taken of the spring element 32 already available to achieve the desired movability in axial direction.

Figure 6A:
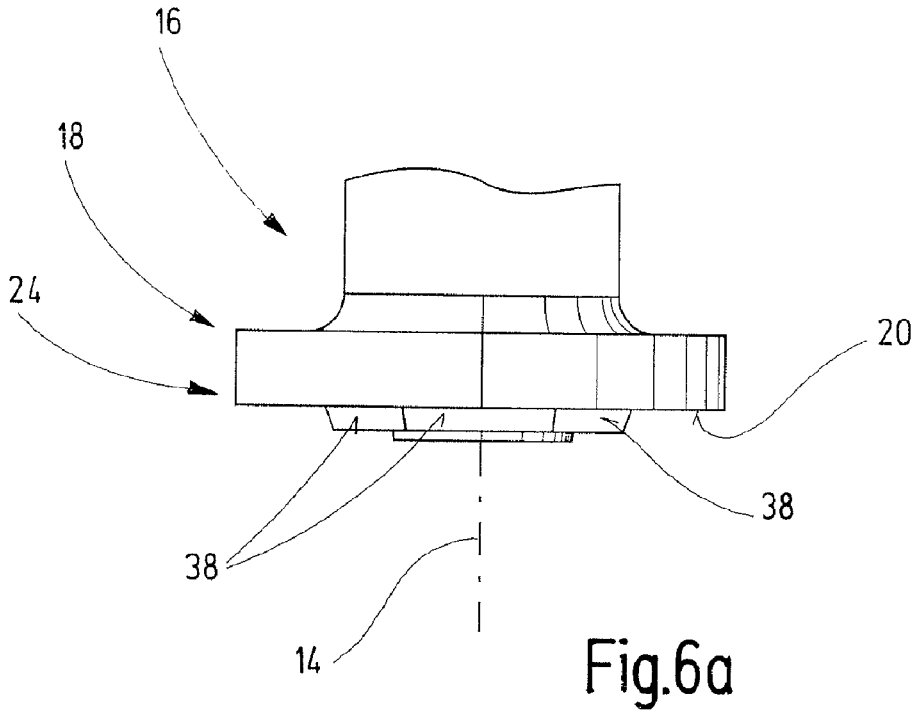
FIG. 6*a* shows a side view of an alternate embodiment of the holding fixture comprising a mounting section in the form of a polygon.
Figure 6B:
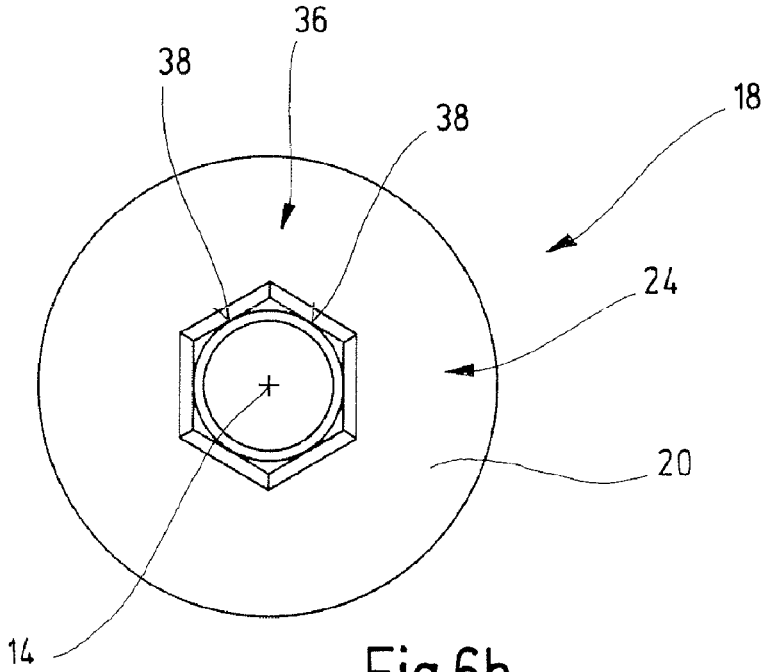
FIG. 6*b* shows a top view of the embodiment illustrated in FIG. 6*a*.

FIGS. 6*a* and 6*b* show one example of an alternate embodiment of the holding fixture 18 with a mounting section 24 in the form of a hexagon. Other irregular or regular polygons, especially rectangles or pentagons, can be chosen as well.

What is claimed is:

1. An oscillatory drive comprising: an output shaft that can be driven rotatingly oscillatingly about its longitudinal axis and that comprises a free end; a holding fixture located at said free end of said output shaft and comprising a contact surface for attachment of a tool; a mounting section provided on said holding fixture being raised relative to said contact surface; a plurality of projections located on said mounting section projecting radially outwardly and being configured for form-locking connection with a mounting opening of said tool placed in contact with said contact surface; and a tension element comprising a spring exerting a biasing force on a securement holding said tool with its mounting opening on said holding fixture; wherein said tool is held on said mounting section to resiliently yield in axial direction under the action of a torque, against said biasing force; and wherein said mounting section permits said tool to rotate by a certain angle of rotation when said tool gives way axially.

2. The oscillatory drive of claim 1, wherein said projections have a symmetric design, related to the direction radial to the longitudinal axis, and each of them comprises two flanks that are interconnected by a common curved area that faces away from said longitudinal axis.

3. The oscillatory drive of claim 2, wherein said flanks approach each other at an angle of between 5° and 35°.

4. The oscillatory drive of claim 2, wherein said flanks approach each other at an angle of between 10° and 25°.

5. The oscillatory drive of claim 2, wherein said flanks approach each other at an angle of between 12° and 18°.

6. The oscillatory drive of claim 2, wherein said flanks terminate by an undercut in an area close to said longitudinal axis.

7. An oscillatory drive comprising: an output shaft that can be driven rotatingly oscillatingly about its longitudinal axis and that comprises a free end; a holding fixture located at said free end of said output shaft and comprising a contact surface for attachment of a tool; a mounting section provided on said holding fixture being raised relative to said contact surface, projecting radially outwardly and being configured for form-locking connection with a mounting opening of said tool placed in contact with said contact surface; and a tension element comprising a spring exerting a biasing force on a securement holding said tool with its mounting opening on said holding fixture; wherein said tool is held on said mounting section to resiliently yield in axial direction under the action of a torque, against said biasing force; and wherein said mounting section permits said tool to rotate by a certain angle of rotation when said tool gives way axially.

8. The oscillatory drive of claim 2, wherein said mounting section widens at least over a certain area in a direction parallel to said longitudinal axis and toward said contact surface.

9. The oscillatory drive of claim 2, wherein said mounting section comprises a plurality of projections that project radially outwardly, related to the longitudinal axis.

10. The oscillatory drive of claim 9, wherein each projection forms at least one flank starting from said contact surface and having a straight line as a base line on said contact surface.

11. The oscillatory drive of claim 10, wherein a surface of said flank forms a planar trapezoid.

12. The oscillatory drive of claim 10, wherein between said flank and said longitudinal axis an angle is enclosed which is between 5° and 40°.

13. The oscillatory drive of claim 10, wherein between said flank and said longitudinal axis an angle is enclosed which is between 10° and 25°.

14. The oscillatory drive of claim 10, wherein between said flank and said longitudinal axis an angle is enclosed which is between 13° and 17°.

15. The oscillatory drive of claim 2, wherein said securement comprises a section being selected from the group formed by an elastic section and a resilient section.

16. The oscillatory drive of claim 2, wherein said mounting section has a polygonal cross-section.

17. The oscillatory drive of claim 2, wherein said mounting section has a hexagonal cross-section.

18. An oscillatory drive comprising: an output shaft that can be driven rotatingly oscillatingly about its longitudinal axis and that comprises a free end; a holding fixture located at said free end of said output shaft and comprising a contact surface for attachment of a tool; a mounting section provided on said holding fixture being raised relative to said contact surface, projecting radially outwardly and being configured for form-locking connection with a mounting opening of said tool placed in contact with said contact surface; and a securement for fixing the tool with its mounting opening on said holding fixture; wherein said tool is held on said mounting section to resiliently yield in axial direction under the action of a torque, against a pre-stress; and said mounting section permitting said tool to rotate by a certain angle of rotation when said tool gives way axially.

19. The oscillatory drive of claim 18, wherein said output shaft comprises a tension element on which said securement is received.

20. The oscillatory drive of claim 19, wherein said tension element is biased by a spring element.

* * * * *